US010815780B2

(12) United States Patent
Crompton et al.

(10) Patent No.: US 10,815,780 B2
(45) Date of Patent: Oct. 27, 2020

(54) RESIN ANCHORED ROCK BOLT WITH A PIERCING END

(71) Applicant: EPIROC HOLDINGS SOUTH AFRICA (PTY) LTD, Johannesburg (ZA)

(72) Inventors: Brendan Robert Crompton, Johannesburg (ZA); James William Sheppard, Johannesburg (ZA)

(73) Assignee: EPIROC DRILLING TOOLS AB, Orebro (SE)

( * ) Notice: Subject to any disclaimer, the term of this patent is extended or adjusted under 35 U.S.C. 154(b) by 0 days.

(21) Appl. No.: 16/616,829

(22) PCT Filed: Jun. 7, 2018

(86) PCT No.: PCT/ZA2018/050031

§ 371 (c)(1),
(2) Date: Nov. 25, 2019

(87) PCT Pub. No.: WO2018/227218

PCT Pub. Date: Dec. 13, 2018

(65) Prior Publication Data

US 2020/0088031 A1 Mar. 19, 2020

(30) Foreign Application Priority Data

Jun. 7, 2017 (ZA) ..... 2017/03891

(51) Int. Cl.
*E21D 21/00* (2006.01)
*E21D 20/02* (2006.01)

(52) U.S. Cl.
CPC ..... *E21D 21/0026* (2013.01); *E21D 20/026* (2013.01); *E21D 21/00* (2013.01)

(58) Field of Classification Search
CPC ..... E21D 21/00; E21D 20/02; E21D 20/021; E21D 20/023; E21D 20/025; E21D 20/026; E21D 20/028
(Continued)

(56) References Cited

U.S. PATENT DOCUMENTS 3,973,409 A * 8/1976 Asayama ..... E02D 5/74 405/259.5
4,055,051 A 10/1977 Finney
(Continued)

FOREIGN PATENT DOCUMENTS

DE 102010004926 * 11/2010
WO 96/07015 A1 3/1996
WO 2013/152393 A1 10/2013

OTHER PUBLICATIONS

International Search Report (ISR), dated Dec. 10, 2018, from corresponding international application No. PCT/ZA2018/050031.

*Primary Examiner* — Sunil Singh
(74) *Attorney, Agent, or Firm* — Nixon & Vanderhye

(57) ABSTRACT

Disclosed is a resin bolt which includes an elongate shaft which extends between a leading end and a trailing end and a positioning head which is integral to the shaft at the leading end and which extends in the elongate axis of the shaft from a perimeter rim to a crown, with the head formed with a plurality of projections, with each projection extending laterally, beyond the radial dimension of the shaft and each projection having a leading surface which slopes, at least partially, from the crown to the perimeter rim, and a trailing surface from the perimeter rim to the shaft.

5 Claims, 11 Drawing Sheets

(58) Field of Classification Search
USPC ..... 405/259.1, 259.5, 259.6
See application file for complete search history.

(56) References Cited

U.S. PATENT DOCUMENTS 4,744,699 A 5/1988 Price et al.
6,033,153 A 3/2000 Fergusson

* cited by examiner

RESIN ANCHORED ROCK BOLT WITH A PIERCING END

BACKGROUND OF THE INVENTION

This invention relates to a rock bolt for use in a resin anchored application.

It is well known in the art to anchor a rock bolt into a rock hole with a grout or a two-part resin. The grout or resin is introduced into the rock hole, ahead of the bolt, by means of grout or resin capsules.

The rock bolt has to be adapted to puncture the capsule to release the contents. With the two-part resin, the contents have to be thoroughly mixed to achieve optimal setting.

Strictly, the resin is not an adhesive as it does not adhere the rock bolt to the rock hole. The resin mechanically locks the rock bolt in the rock hole. Thus, there is a reliance upon mechanical interlock with irregularities in the surface of the rock bolt and the rock hole walls to prevent the rock bolt from being pulled from the rock hole. The irregularities on the surface of the rock bolt are provided by a profiled surface.

Another factor influencing optimal mechanical lock is how efficient the rock bolt is at mixing the two parts of the resin. Typically mixing efficiency decreases in a radial direction from the surface of the rock bolt to the rock hole wall. This means that the larger the ratio between the diameter of rock hole and the rock bolt, i.e. the larger the annular space between the rock bolt and the rock hole wall, the greater the mixing inefficiency towards an outer circumference of the annular space. Potentially, this reduces the load bearing capacity of the rock bolt.

This factor places a limit on the diametric size of the rock bolt that can be used for a particular hole size. There is economic motive to using as small a rock bolt as possible.

A resin rock bolt therefore must have features which are a compromise between a mixing and an anchoring function. Unfortunately, the functions are not complementary. Optimising the mixing features tends to decrease the anchoring abilities of the bolt. A typical rock grouted resin anchored rock bolt is profiled with a series of ridges angled at 45°. These ridges provide a compromise between anchoring and mixing functionality.

Gloving is another problem in resin bolting. This phenomenon occurs when the plastic wall of the capsule is incompletely broken up or disrupted by the rock bolt when the bolt penetrates the capsule. The plastic then coats part of the rock bolt, covering the profiled surfaces of the rock bolt and decreasing its anchoring and mixing functionality.

Yet another issue in resin bolting is that the rock bolt is very rarely inserted in complete co-axial alignment with the rock hole causing eccentricity of the bolt to the rock hole, about the distal end of the bolt. At the distal end, the annular space is irregular, with a thin and a thick annular arc. In the thin annular arc there is insufficient resin to provide optimal mechanical interlock. Whilst in the thick annular arc, the resin is insufficiently mixed. And with insufficient resin in the small annular arc, the protective barrier provided by the resin is thinned, increasing the chance of acid mine water penetrating to the rock bolt.

Both eccentricity and gloving tends to occur in the critical top of the leading end section of the installed bolt.

The invention aims, at least partly, to address the aforementioned problems.

SUMMARY OF THE INVENTION

The invention he invention provides a resin bolt which includes an elongate shaft which extends between a leading end and a trailing end and a positioning head which is integral to the shaft at the leading end and which extends in the elongate axis of the shaft from a perimeter rim to a crown, with the head formed with a plurality of projections, with each projection extending laterally, beyond the radial dimension of the shaft and each projection having a leading surface which slopes, at least partially, from the crown to the perimeter rim, and a trailing surface from the perimeter rim to the shaft.

The projections may be lobes or ridges or the like.

The trailing surface may be a planar surface.

Preferably, the positioning head has at least three projections which are equally radially spaced to centralise the position of the leading end of the shaft in a rock hole in use.

Preferably, the projections have even lateral reach.

The positioning head may be formed with a plurality of concave recessed or slotted formations, each between a pair of adjacent projections, to provide passages for the flow of resin in use.

The crown may be an apex or a tip to provide a means for penetrating a resin capsule or cartridge in use.

The leading surface of each projection may have a bladed edge which extends in a radial direction as a means to further break up and disrupt a resin cartridge in use.

The resin bolt may include at least one integrally formed paddle formation on the shaft, behind the positioning head.

A positioning head for use with a resin bolt which includes a body which has a crown, a leading surface, a trailing surface separated from the leading surface by a perimeter rim, and an attachment means on the base surface for attaching the head to an end of the resin bolt, wherein the body is formed with a plurality of projections, each of which extends laterally and wherein the leading surface of each projection slopes, at least partially, from the crown to the perimeter rim.

The projections may be lobes or ridges or the like.

The positioning head may be a solid body made of a suitable metal or rigid composite or plastic material.

The trailing surface may be planar.

Preferably, the positioning head has at least three projections which are equally radially spaced to centralise the position of a leading end of the resin bolt to which the head is engaged in use.

Preferably, the projections have even lateral reach.

The attachment means may be a threaded male or female element.

The positioning head may be formed with a plurality of concave recessed or slotted formations, a between each pair of adjacent projections.

The crown may be an apex or a tip to provide a means for penetrating a resin capsule or cartridge in use.

The leading surface of each projection may have a bladed edge which extends in a radial direction.

A resin bolt which includes an elongate shaft which extends between a leading end and a trailing end and a penetrating head, integrally formed with the shaft from the leading end, which extends in the elongate axis from a base to a tip, a diametrically opposed pair of uniform ridged barbs formed in an outer surface of the penetrating head, each of which projects backwardly from the tip to end at the base where the barb exceeds the radial dimension of the shaft.

BRIEF DESCRIPTION OF THE DRAWINGS

The invention is further described by way of example with reference to the accompanying drawings in which.

DESCRIPTION OF THE PREFERRED EMBODIMENT

Figure 1:
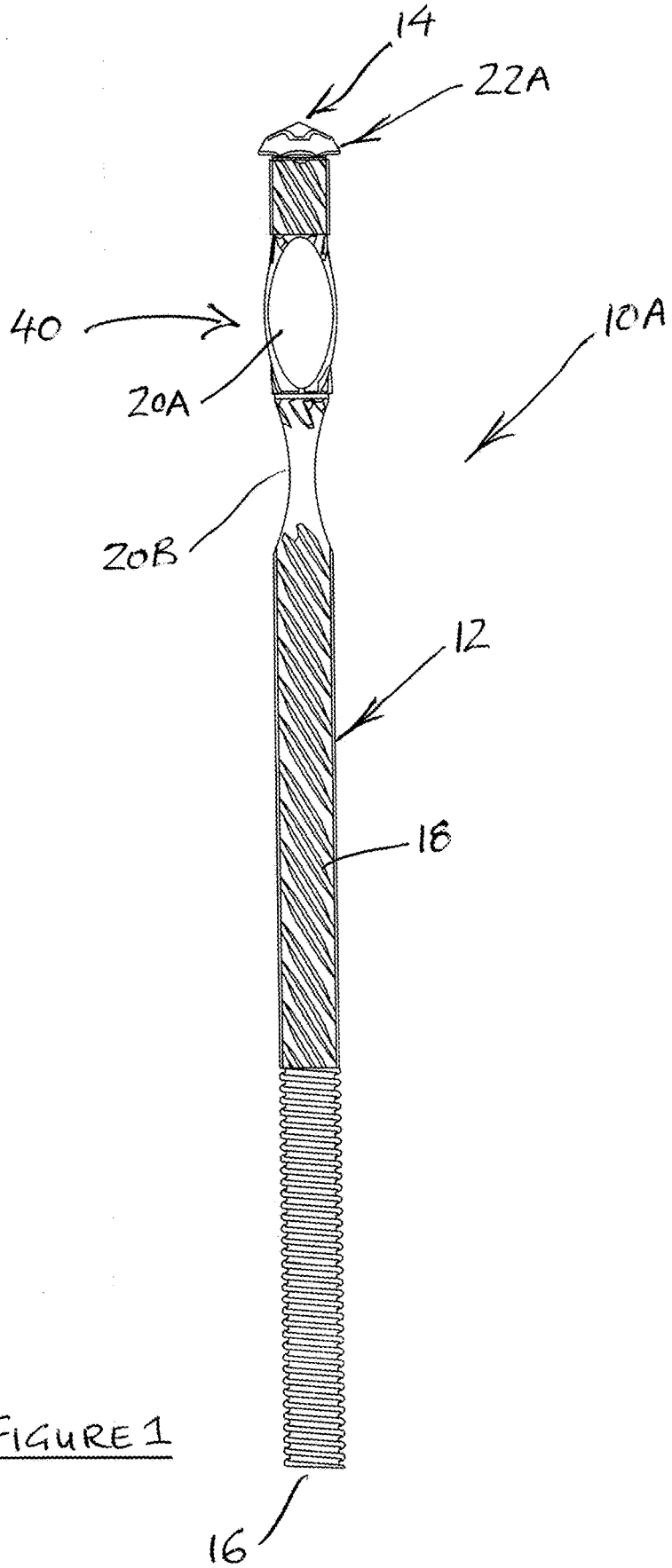
FIG. 1 is a view in elevation of a resin bolt in accordance with a first embodiment of the invention.
Figure 2:
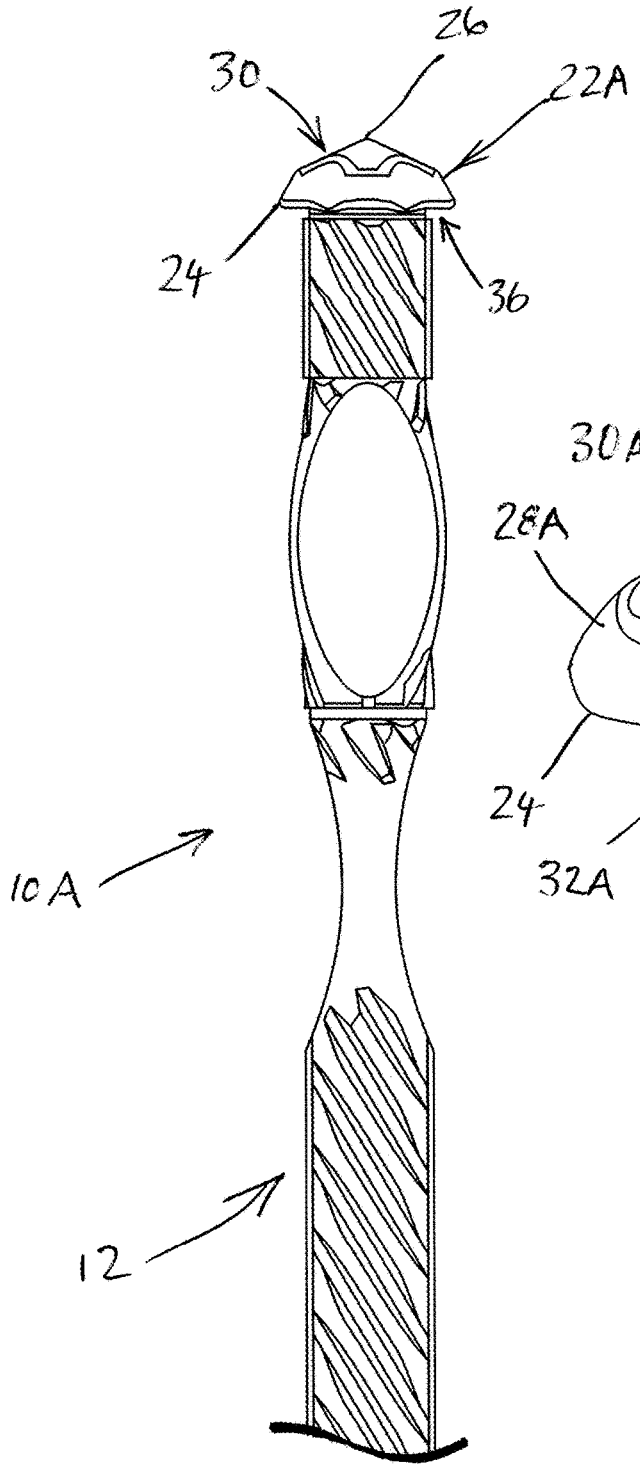
FIG. 2 is a leading end portion of the resin bolt of FIG. 1.
Figure 3:
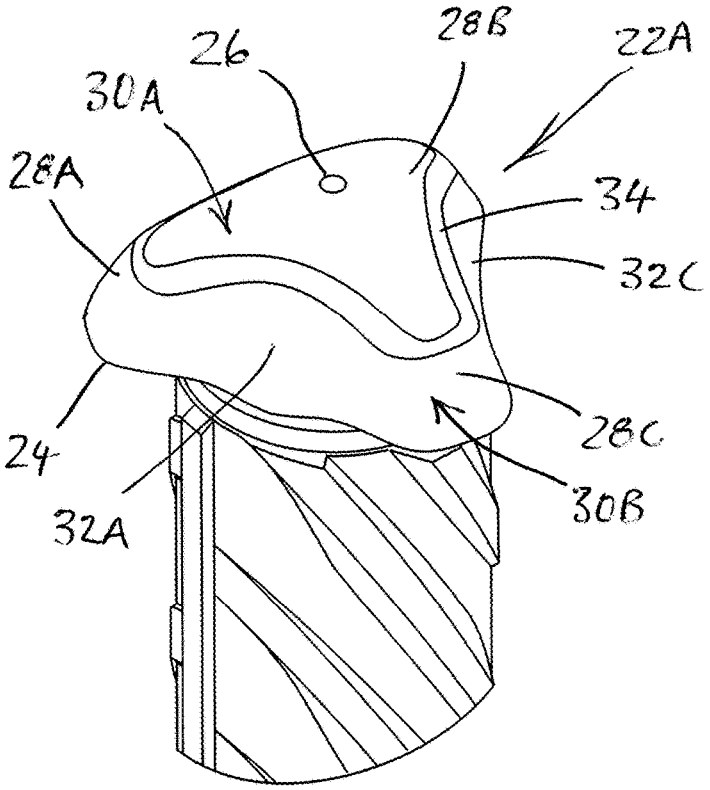
FIG. 3 is an isometric view of a penetrating end of the resin bolt of FIG. 1.
Figure 4:
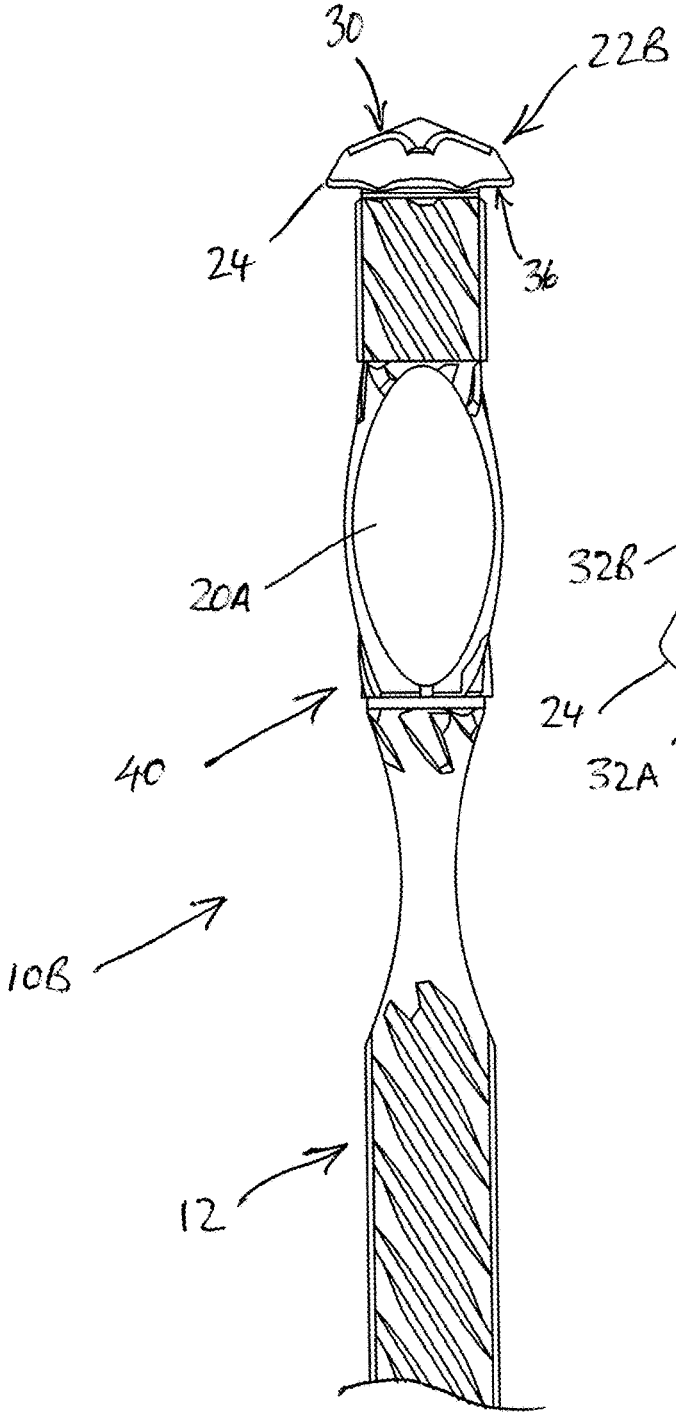
FIG. 4 is a partial view in elevation of a resin bolt in accordance with a second embodiment of the invention.
Figure 5:
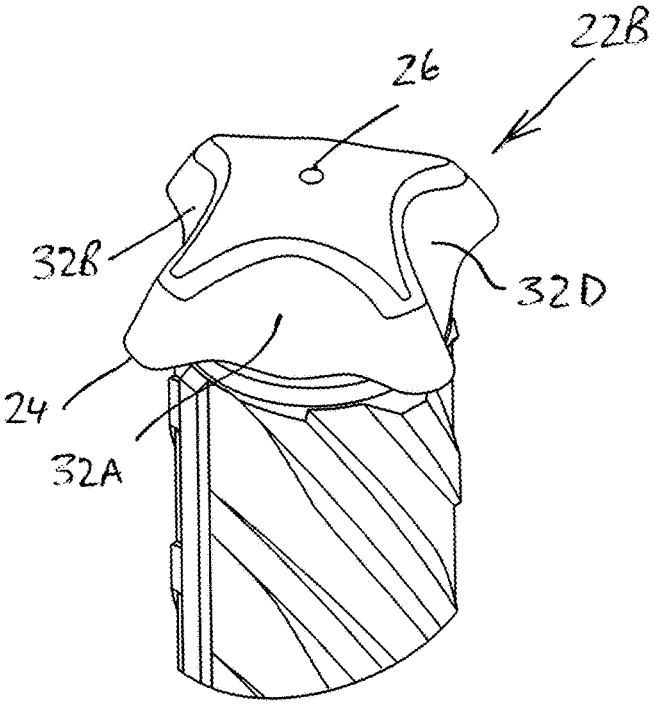
FIG. 5 is an isometric view of a penetrating end of the resin bolt of FIG. 4.
Figure 6:
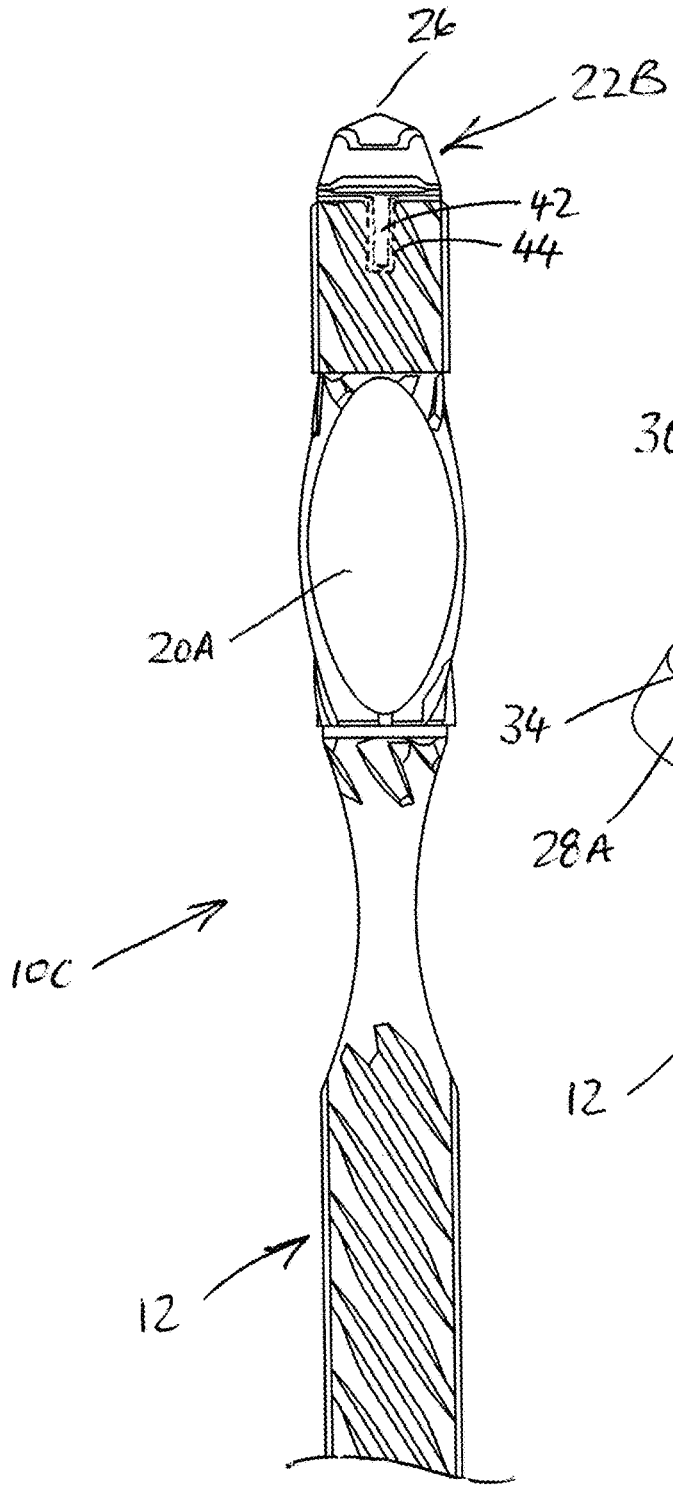
FIG. 6 is a partial view in elevation of a resin bolt in accordance with a third embodiment of the invention.
Figure 7:
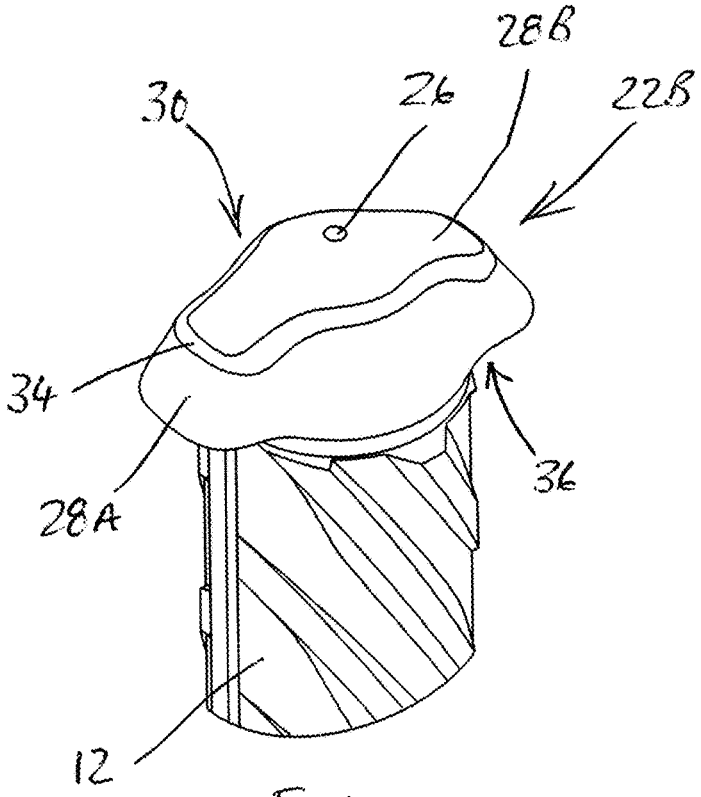
FIG. 7 is an isometric view of a penetrating end of the resin bolt of FIG. 6.

With reference to FIGS. 1, 2 and 3, a first embodiment of the invention is described. This embodiment provides a resin bolt 10A which has an elongate solid steel shaft 12 which extends between a leading end 14 and a trailing end 16.

The shaft of the resin bolt 10A in this example is of typical manufacture with a series of profiled ridges 18 formed on an outer surface of the shaft. And, in this particular embodiment, the resin bolt has a pair of paddle formations, respectively designated 20A and 20B, which are integral to the body with the plane of each paddle offset by 90°. The paddles not only increase the diametric reach of the resin bolt in mixing the resin content of pre-installed resin capsules (not shown) but also increase the anchoring of the bolt within the rock hole.

At the leading end 14 of the shaft 12, the resin bolt has an integrally formed positioning head 22A. The head is peaked, extending in the elongate axis of the shaft, from a base edge or side 24 to a crown 26 which, in the examples that follow, is an apex or tip.

Figure 8A:
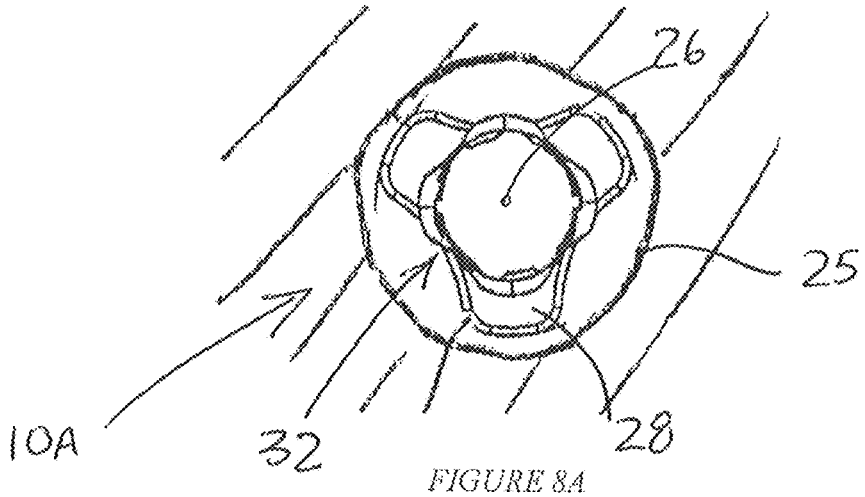
FIGS. 8A, 8B and 8C are each a view in cross-section from the penetrating end of a rock bolt of FIGS. 2, 4 and 6 respectively.
Figure 8B:
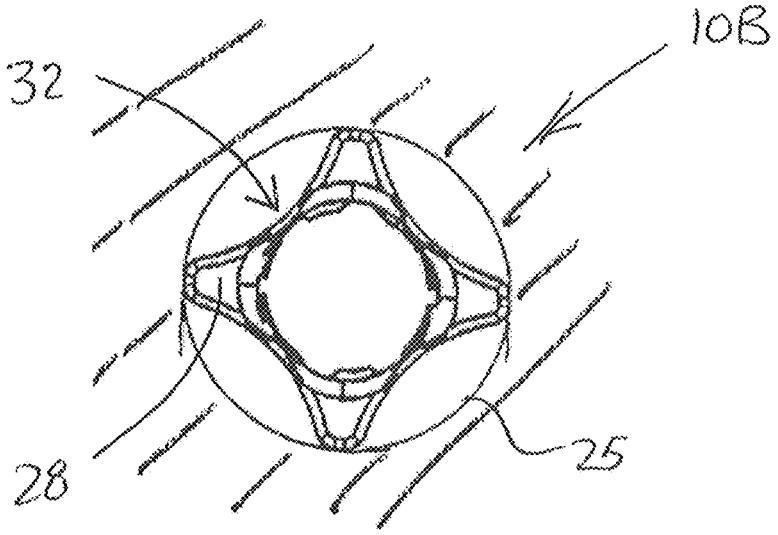
Figure 8C:
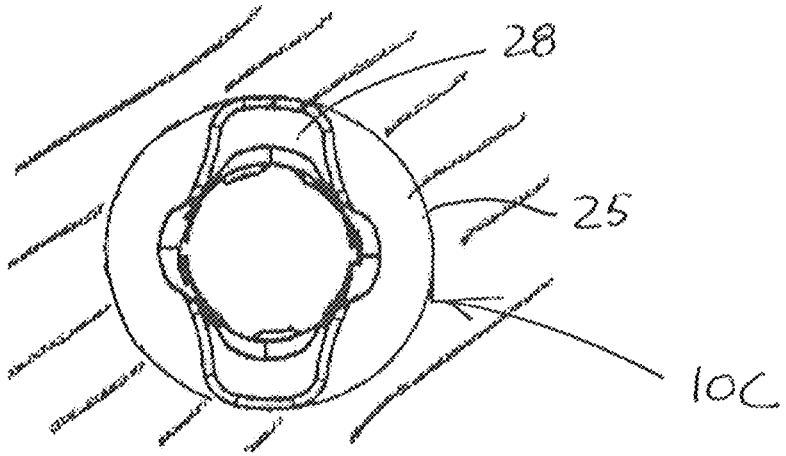

The positioning head is formed with a plurality of lobes, respectively designated 28A, 28B, 28C. Each of the lobes has equal lateral reach and is evenly radially spaced, this is particularly evident in FIG. 8A. Between the lobes, on a leading surface 30, the head is indented into a plurality of concave recesses, respectively designated 32A, 32B and 32C.

Each of the lobes 28 slopes from the apex 26 to the base edge 24. In this example, the slope is stepped, with a gradual sloping surface 30A, which ends along a relief line 34, and a steeper sloping surface 30B, which extends between the relief line and the base edge. At the base edge, each lobe exceeds and overlaps the radial dimension of the shaft, providing a planar trailing surface 36 which extends from the base edge to the shaft 32.

In use, the resin bolt 10A is inserted into a rock hole 25, positioning head 22 leading. The apex 26 of the head aids in puncturing the frangible wall of the resin capsule or capsules, which have been pre-installed into the rock hole, as the resin bolt advances. The lobes 28 are sized to a diameter larger than the capsule diameter to force the capsule to shred or be pushed to the very top of the hole, ahead of the leading end 14. This prevents the gloving phenomenon from occuring.

At the same time, the concave recesses 32 provide channels for the passage of the resin contents of the ruptured capsules past the advancing positioning head, reducing resistance to the advance of the resin bolt.

The lobes 28 also perform the function of centralizing the resin bolt, as the bolt is inserted, at least along a leading end portion 40. This is a consequence of the lobes uniformity in both circumferential separation and lateral extent. With one or more lobes abutting the hole wall 38 at any given time, at the base edge, the bolt is keep concentric relatively to the hole.

The resin bolt 10A is spun, as it is inserted into the rock hole to maximise the shredding effect of the positioning head 22A on the cartridges. The lobes 28 centralise the bolt in this process. The paddles 20, trailing the penetrating head 22A, can optimally mix the resin components as they travel past the penetrating head, into the annular space behind the trailing surface 36.

As the resin hardens, the trailing surface 36 provides a locking surface that acts against the set resin to prevent the bolt form being pulled from the hole.

FIGS. 4 and 5 and FIGS. 6 to 7 respectively illustrate a second embodiment (resin bolt 10B) and a third embodiment (resin bolt 10C). Each of these embodiments differ in the number of lobes 28 on the penetrating head 22. In bolt 10B, the penetrating head 22B has four lobes, respectively designated 28A, 28B, 28C and 28D on FIG. 5. In bolt 10C, the head 22C is anvil-shaped with a pair of lobes, respectively designated 20A and 28B of FIG. 7.

Although each of the embodiments illustrated show the positioning head formed integrally with the shaft, the penetrating head 22 can be a discrete element which is attached to the leading end 14 of the shaft 12. Attachment of the head can be by achieved in any suitable way. For example, the head may have a threaded member on the trailing surface 36 which can engage with a threaded recess 44 in the leading end. This attachment feature is illustrated on FIG. 6, in dotted outline. The head also can be fixed by welding.

The positioning head 22, as a discrete element, can be made of any suitable rigid material. It can be, for example, made of a rigid plastics material.

It is contemplated within the scope of the invention that the bolt 10 can have any suitable combination of a plurality of positioning heads (22) and paddles (20) spaced along the shaft 12.

To illustrate the centralisation effect on a resin bolt 12 afforded by a positioning head 20, a standard bolt was tested against a resin bolt in accordance with the invention. The standard bolt is a typical paddled bolt which has a leading end which is cropped at 45°. Both types of bolts were installed in steel tubes with an internal diameter of 38 mm, and encased in resin. The tubes represent a rock hole. Each sample was then sliced along its length into approximately 50 mm segments and these segments were then analysed to determine the degree of eccentricity or centralisation.

Figure 9:
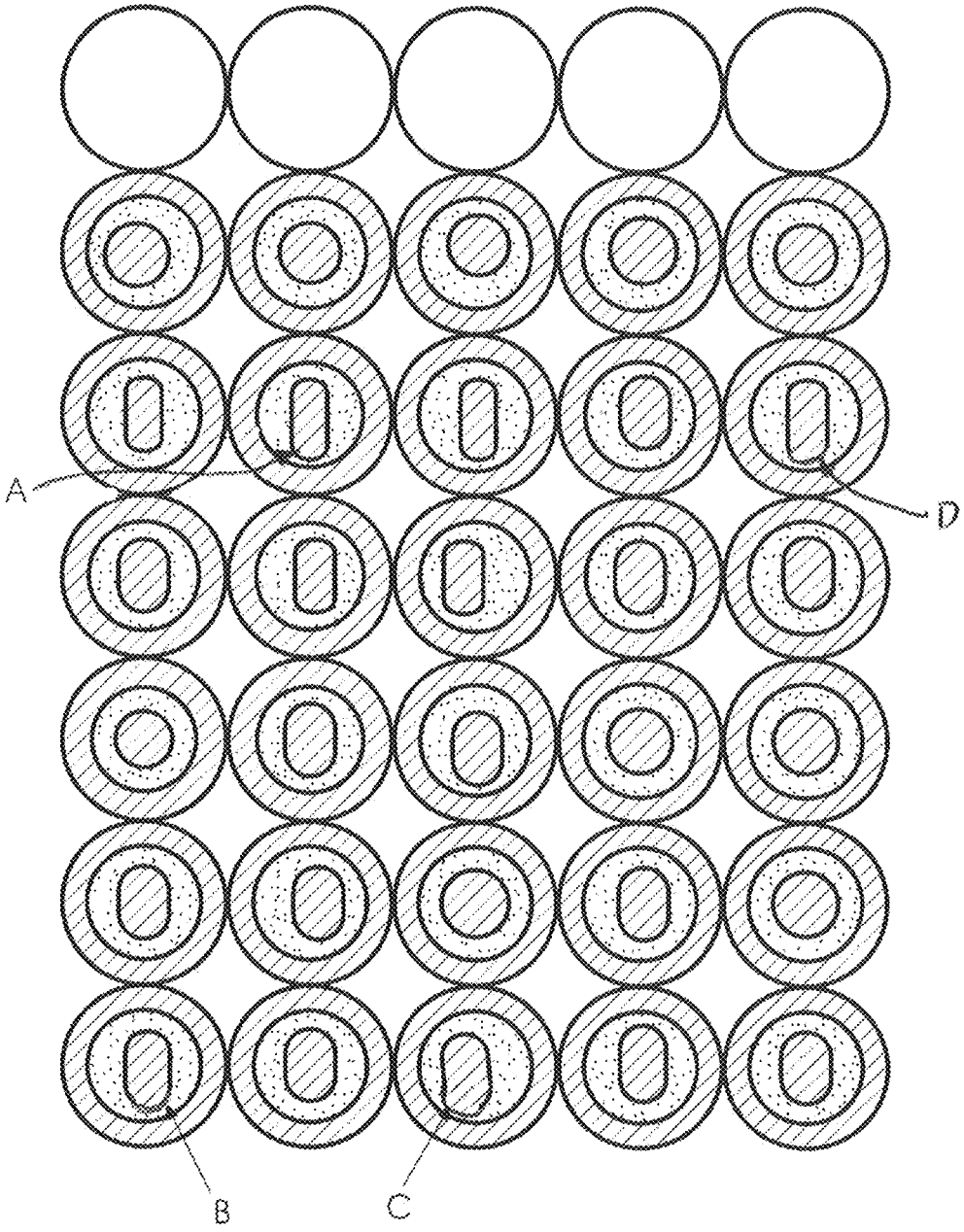
FIG. 9 is a photograph showing four columns, each row representing a single resin encased bolt, in a tube, sectioned at intervals.

The first test was conducted on a set of five standard bolts, with a 45° cropped tip, as commonly used. FIG. 9 shows the 50 mm slices cut through the five test samples of these standard bolts. Eccentricity of the installed resin bolts is clearly observed. Notably, a number of the bolts were in close proximity to, or contacting, the inner wall of the steel tubes. These contact areas are designated A, B, C and D on FIG. 9. In application underground, this eccentric positioning would offer little corrosion protection to the installed resin bolt.

Figure 10:
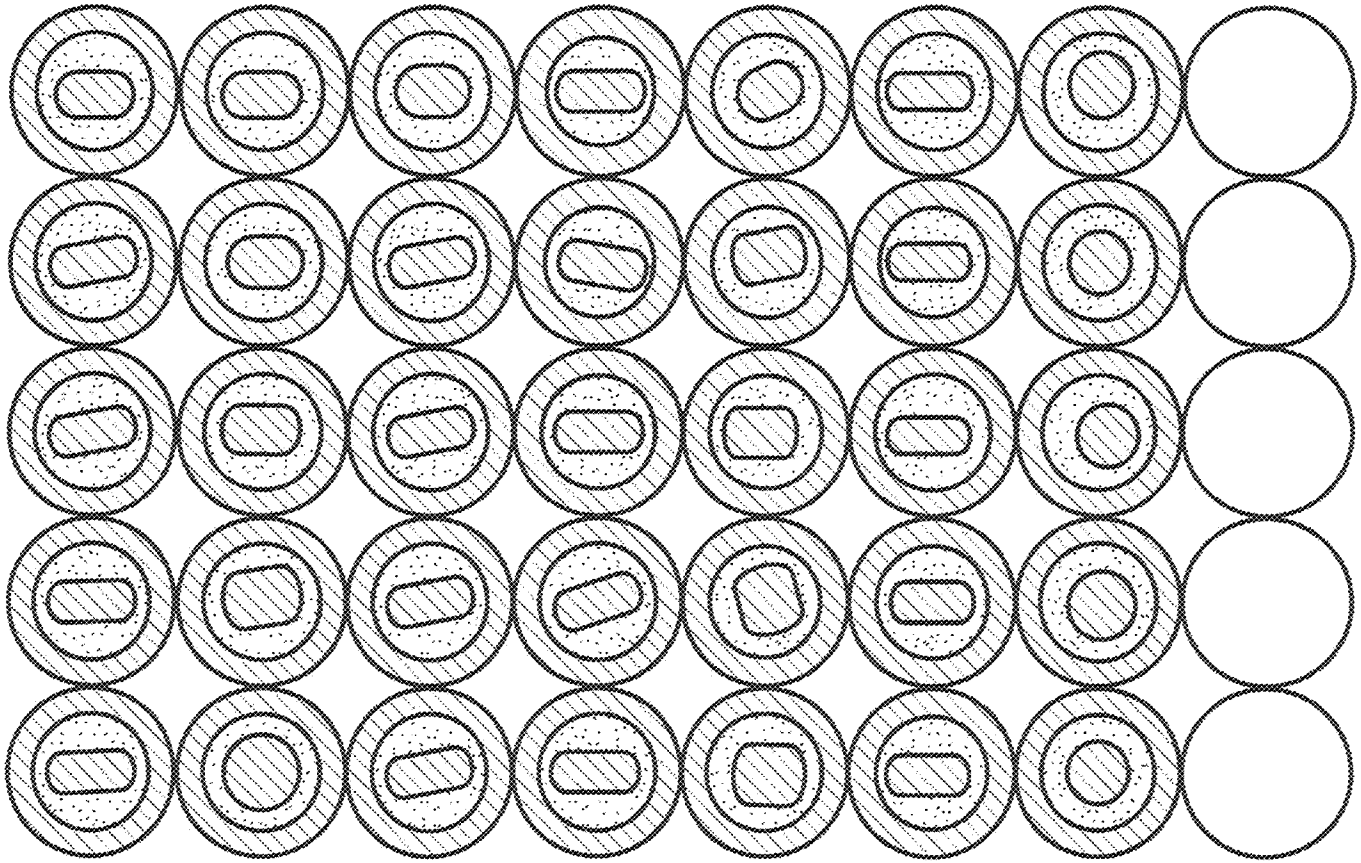
FIG. 10 is a photograph showing five rows, each row representing a single resin encased bolt, in accordance with the invention, in a tube, sectioned at intervals.

FIG. 10 shows the segments sliced from a set of five different diameter resin bolts with a tri-lobed positioning head 20, in accordance with the first embodiment of the invention, after installation in the tubes.

The centralisation provided by the tri-lobed head on the resin bolts is noticeably better than with the conventional 45° cropped tip design. None of these bolts came into contact with the inner wall of the tube. Significantly, these sections are through the critical top anchoring section of the installed resin bolt.

Figure 13:
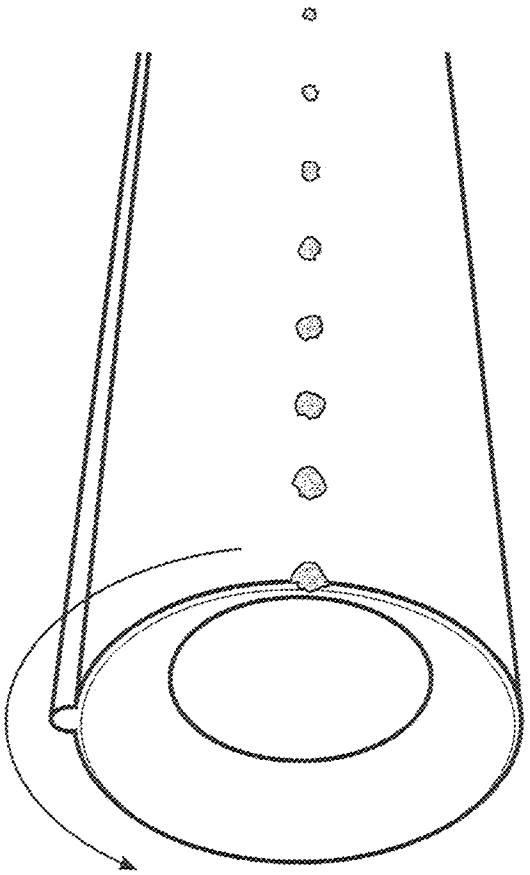
FIG. 13 is a photograph of a resin encased resin bolt, showing a line of voids in the resin.

To illustrate a further disadvantage with eccentric positioning, a line of voids occurred along the length of the standard ribbed bar sample, see FIG. 13. On examination, it was found that the line correlates with the thin resin annulus in the cross-section of the sample.

Being installed eccentrically the bolt wall spin eccentrically in the tube. As the bolt moves around the perimeter of the tube the ribs of the rotating bolt scour the resin from the inside of the tube at the point of thinnest resin annulus. The rotation of the bolt due to the revolution of installation machinery is indicated by a large diameter arrow and the eccentric rotation of the bolt around the tube is indicated by a small diameter arrow.

Figure 11:
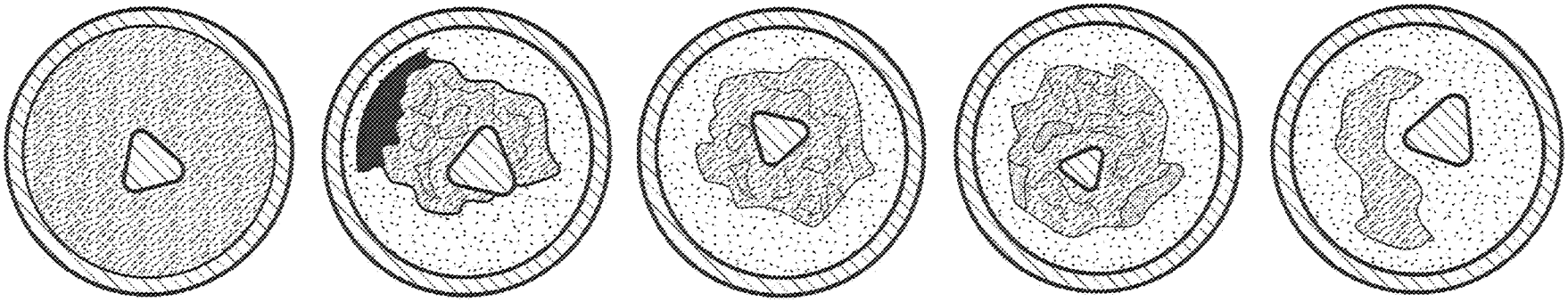
FIG. 11 is a photograph of a series of tubes which have been sectioned to show, in each, a sectioned leading end of a resin encased rock bolt.

In order to assess to what extend the tri-lobed head 22A breaks up the Mylar filling of a mastic resin capsule, the ends were cut off a number of resin bolt samples spun into steel tubes. As can be seen in FIG. 11, the lobed head is effective at shredding the capsule as it moves through the capsule.

Figure 12:
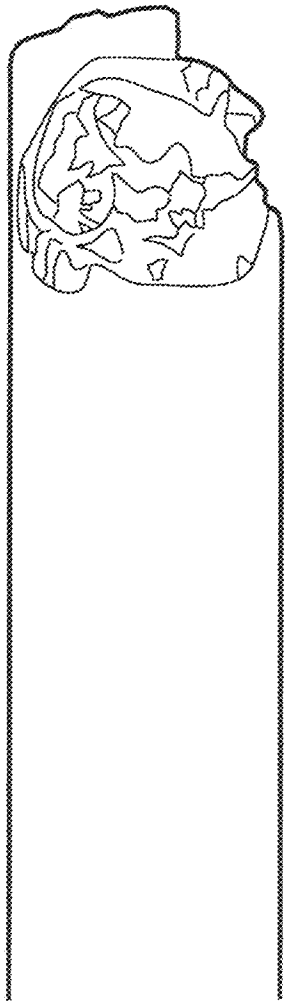
FIG. 12 is a photograph of a leading end of a resin encased bolt showing the resin capsule packaging bunched towards a leading end of the bolt.

FIG. 12 is an example of a resin bolt in accordance with the invention installed into a Perspex tube, encased with resin and then the tube removed. The Mylar packaging of the resin capsule is almost entirely located at the top of the bolt, ahead of the anchoring zone, showing that the positioning head 20 of the bolt is not only effective at shredding the packaging, it is also effective at keeping the packaging away from the anchoring zone behind the trailing surface 36 of the positioning head.

A series of Short Encapsulation Pull Tests (SEPT) were conduced and standard resin bolts and resin bolts in accordance with the invention, to comparatively determine the head carrying capacity of each version.

Figure 14:
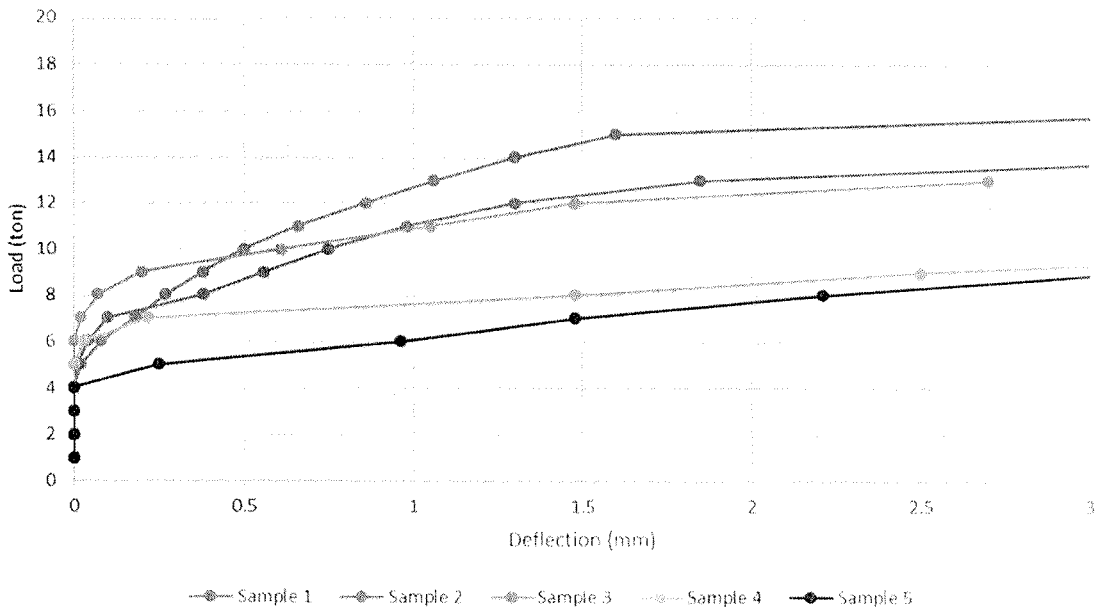
FIG. 14 is a load/deflection graph representing the results of pull-out tests conducted on five samples of a resin bolt in accordance with the prior art.

The standard bolt tested was a 20 mm deformed bar, with four anchoring paddles and a 45° cropped tip. The results of the SEPT are illustrated in the graph of FIG. 14. The results show that two of the test samples, that is 40% tested, did not achieve a 10-ton load capacity and continued to slip through the resin at approximately 9.5 tons when tested in the 38 mm hole.

Figure 15:
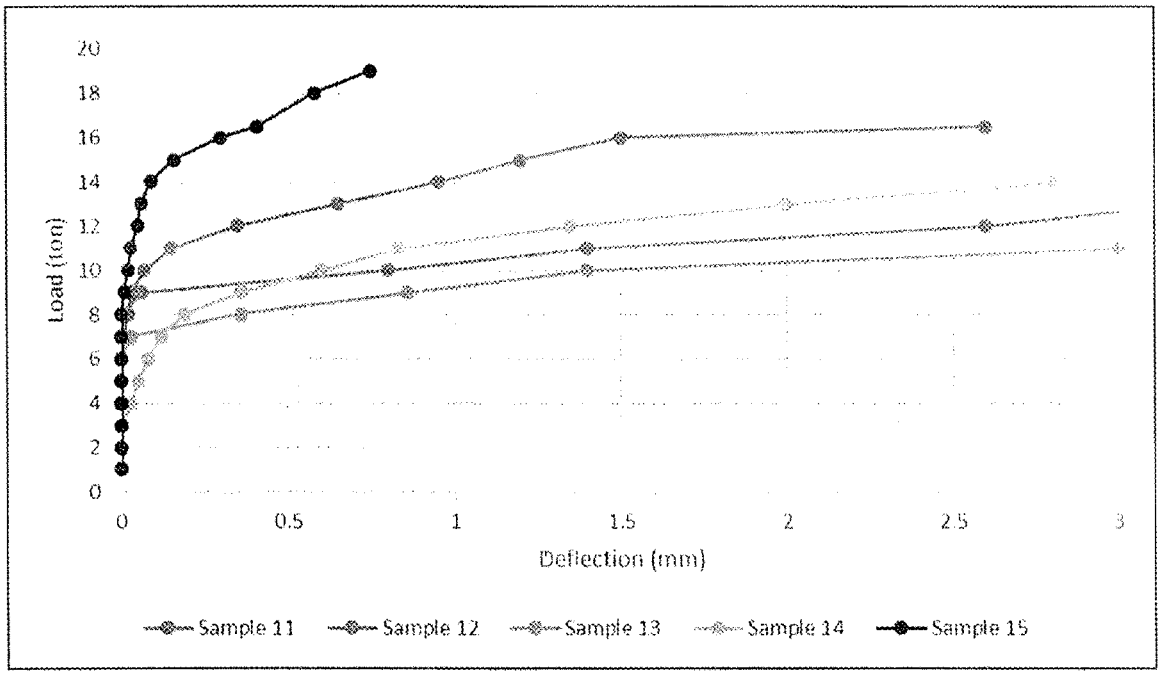
FIG. 15 is a load/deflection graph representing the results of a pull-out test conductive a five samples of a resin bolt in accordance with the invention.

The resin bolt of the invention was a 20 mm diameter deformed bar, with four anchoring paddles and a tri-lobe positioning formation 20, in accordance with the first embodiment of the invention. The results of the SEPT on these bolts are illustrated in the graph of FIG. 15. The results show that all five of the test samples achieved a 10-ton load capacity as required when tested in the 38 mm hole.

The invention claimed is:

1. A resin bolt, comprising:

an elongate shaft which extends between a leading end and a trailing end; and a positioning head which is integrally formed with, or engaged to, the shaft at the leading end and which extends in an elongate axis of the shaft from a perimeter rim to a crown, with the head formed with at least three equally radially spaced lobes, each lobe equally laterally extending beyond the radial dimension of the shaft, each lobe having a leading surface which slopes from the crown to the perimeter rim, and a trailing surface which extends from the perimeter rim to the shaft, and the positioning head is formed with a plurality of concave recessed formations, each between a pair of adjacent lobes.

2. The resin bolt according to claim 1, wherein the trailing surface is a planar surface.

3. The resin bolt according to claim 1, wherein the crown is an apex or penetrating tip.

4. The resin bolt according to claim 1, wherein the leading surface of each lobe has a bladed edge which extends in a radial direction.

5. The resin bolt according to claim 1, wherein the resin bolt includes at least one integrally formed paddle formation on the shaft, behind the positioning head.

* * * * *